US005749616A

United States Patent [19]

Steever

[11] Patent Number: 5,749,616

[45] Date of Patent: May 12, 1998

[54] HOSE BED DIVIDER FOR A FIRE TRUCK

[75] Inventor: Joel A. Steever, Reading, Pa.

[73] Assignee: Thomas Body Parts, Inc., Reading, Pa.

[21] Appl. No.: 739,190

[22] Filed: Oct. 30, 1996

[51] Int. Cl.[6] ..... A62C 27/00

[52] U.S. Cl. ..... 296/37.6; 296/39.1; 410/103; 211/59.4; 211/184; 211/207

[58] Field of Search ..... 296/39.1, 39.2, 296/37.6; 211/59.3, 59.4, 183, 184, 190, 207, 208; 410/129, 130; 220/500, 529, 534, 549, 550, 551

[56] References Cited

U.S. PATENT DOCUMENTS

| | | | |
|---|---|---|---|
| 619,323 | 2/1899 | Macey | 220/550 X |
| 1,608,401 | 11/1926 | Kress | 211/184 X |
| 2,116,373 | 5/1938 | Williamson | 220/550 |
| 3,746,181 | 7/1973 | Benoit | 211/184 |
| 4,901,869 | 2/1990 | Hawkinson et al. | 211/59.3 |
| 5,199,584 | 4/1993 | Fowler et al. | 211/184 |
| 5,211,351 | 5/1993 | De Clerck | 296/37.6 X |
| 5,372,396 | 12/1994 | Nahmen | 296/39.2 |
| 5,584,412 | 12/1996 | Wang | 224/925 X |

*Primary Examiner*—Dennis H. Pedder

[57] ABSTRACT

An elongated divider panel comprising a widened bead-like top rail, an integrally attached thin intermediate portion and an integrally attached widened mount-base at the bottom thereof. The mount-base rests atop strut channel members, and is adjustably securable thereon allowing the divider panel to be shifted laterally as desired. The mount-base includes vertical through-bores for accepting bolts for bolting the mount-base atop the strut channel members. Spring-nuts are utilized within the strut channel members to receive the bolts mounting the mount-base. The vertical bores of the mount-base include space to recess the bolt heads. Multiple strut channel members are used in spaced parallel relationship to one another and extending transversely to the long axis of a fire truck cargo bed and the divider panel. Plank-like metal slats extend lengthwise between the strut channel members and define a cargo bed false-bottom the top of which is approximately flush yet slightly below the top surface of the strut channel members so as to not interfere with the lateral repositioning of the divider panel. The divider panel with mount-base and top rail is integrally formed as a one-piece structure by extrusion of aluminum or an alloy thereof. A second and somewhat similar extending panel including a grooved attachment-base is provided for attachment to the top rail of the divider panel for extending the overall height of the divider.

11 Claims, 9 Drawing Sheets

HOSE BED DIVIDER FOR A FIRE TRUCK

BACKGROUND OF THE INVENTION

1. Field of the Invention

This invention relates to dividing arrangements for use in the back-end cargo or hose bed of a fire truck for dividing the cargo or hose bed into multiple sections.

2. Description of the Prior Art

Divider panel arrangements have been used for many years to divide the back cargo or hose bed areas of fire trucks, usually of the type of trucks referred to as pumper trucks, in order to allow for the storage of a large number of serpentine folded high pressure water hoses separate from other gear in the cargo or hose bed. The terms cargo bed and hose bed are herein used interchangeably.

Pumper style fire trucks typically, although not always, have a water carrying tank about the overall size of the back cargo area of the truck behind the cab, with the top of the tank providing the bed of the cargo area. Such water tanks are usually supported and positioned below the back cargo area or bed, and are typically relatively low in height from the ground, such as around 4 feet, so as to leave usable space atop the tank which is not too high from the ground on which to rest fire fighting equipment (cargo), that is, not too high to reach equipment while a fireman stands on the ground. Fire trucks completely absent water tanks or those having the water tank mounted forward of the back-end just behind the cab of the truck commonly also have a cargo bed often used for carrying folded high pressure water hoses. On pumper style fire trucks, typically, tool boxes most commonly fabricated of aluminum are mounted on each lateral side of the cargo bed and extending vertically upward two to three feet, leaving a central open portion of the cargo bed 3 ½ to 5 feet wide between the tool boxes and extending to the back end of the truck for the placement of fire fighting gear such as neatly folded high pressure water hoses, step ladders, portable transfer pumps, portable exhaust fans and the like.

Typically a large number of high pressure water hoses are carried on such a pumper truck, as these are the hoses which are extended from the water output side of the pump on the pumper truck or from a fire hydrant to the fire, which can be many hundreds of feet away. The high pressure hoses can be coupled or connected end-to-end to define a single hose extending from the truck or hydrant to the fire. High pressure fire hoses are subject to high water pressures during use, and it is important to not damage such hoses by the incorrect storage thereof, or by nicking, pinching or crushing, otherwise the hose can burst under the high water pressure. Typically, each high pressure hose is folded in a long, vertically stacked serpentine pattern, and stacked vertically on one lateral side of the cargo bed adjacent a back side of a side tool box. Usually several neatly folded hoses are stacked atop one another, and so the height of the folded hoses can often reach 10 to 30 or so inches depending on the number of stacked hoses. Typically, three to six horizontal rows of the folded stacked hoses are placed in the cargo bed of a pumper truck. In order to keep the vertically stacked hoses from falling laterally sideways, and to define a semi-separate cargo space to one side of the stacked hoses, a hose bed divider or partition extending the typical 6 to 12 foot length of the hose bed is installed, extending from the back end of the cargo area and truck toward the front end of the truck to the front of the cargo bed. The hose bed divider extends vertically upward from the floor or bed usually somewhere between 10 and 36 inches in height. The neat folding and stacking of the high pressure hoses helps keep the hoses from being pinched or otherwise crushed and damaged by other equipment within the cargo bed, and by keeping the hoses neatly stacked and folded by locating them between hard stationary vertical surfaces, the hoses are easily and quickly pulled from the cargo bed for use without any tangling of the hoses occurring. Typically, one vertical surface providing lateral support to stacked folded high pressure fire hoses is the hose bed divider, and the other vertical surface typically two to three feet away is the backside or inward facing surface of a permanently mounted tool box along the peripheral lateral side edge of the cargo bed. Hoses in the middle of the hose stacks are supported laterally by adjacent folded and stacked hoses, since as mentioned above, there is typically three to six horizontal rows of the folded hoses. The hose bed divider provides lateral stability to the stacks of neatly folded fire hoses, and divides the cargo bed into two sections typically extending the full length of the cargo bed. The back-end of the fire truck above the rear bumper is typically left opened or is openable by a canvas or metal closing tailgate to allow easy access to the cargo bed and stored equipment such as the folded stacked fire hoses. The folded high pressure hoses are pulled from the stacks out the open back end of the pumper truck, and it is important that the hoses are quickly removable since time is typically of the essence when fighting fires, and the neat folding and containment of the folded fire hoses as provided by the use of a hose bed divider helps ensure the hoses are not damaged or tangled during transport, and that the hoses can be quickly removed and used.

Typically, prior art hose bed dividers are individually fabricated to the specifications of the particular fire truck builder, or the truck buyers specifications. The most common structure of prior art hose bed divider is a tubular metal outer frame, usually of steel but occasionally of aluminum, and defining the outer periphery of the divider, with a flat sheet of metal which is also usually of steel but sometimes of aluminum cut to the approximate size of the frame, and welded to the frame to define the solid center portion of the panel. The frame stands vertically oriented when mounted in the truck, and most commonly includes multiple laterally extending tabs of metal, individually cut, placed and welded in place at spaced intervals along the frame bottom edge, and the tabs include bolt or screw holes to allow the fastening of the tabs to the cargo bed floor or to strut channel members. Since the bolting of the tabs is most typically directly over the top of the water tank, so as to not puncture the tank, a false floor is normally installed over the water tank top if strut channel members are not utilized. In some cases in the prior art, the vertical hose bed dividers have been mounted atop strut channel members in a manner allowing the backing-off of mounting bolts between the mount tabs of the divider and spring-nuts captive in the strut channel to allow the sliding re-positioning of the divider panel laterally in the hose bed to re-defined the size of the storage space on each side of the divider panel. Such individually fabricated hose bed dividers are labor intensive to manufacture, and those made of steel must initially be painted to prevent rusting, and must be periodically repainted, the re-painting being a costly maintenance measure. Such hose bed dividers formed of a peripheral tubular frame having a plate cut to size and welded to the frame are labor intensive to manufacture, and thus are relatively costly in the short term.

Hose bed dividers of the prior art for use in fire trucks typically have shortcomings including being too high in price because they are not mass produced or designed such that they could be efficiently mass produced using efficient machinery requiring little human labor. Another shortcoming in prior art hose bed dividers is that they are not sufficiently durable, being too easily damaged, i.e. dented in the thin sheet-metal center portion, bent or scratched; being insufficiently resistant to corrosion and typically requiring repeated painting. Another shortcoming in some prior art hose bed dividers is that they are not readily adjustable in position within the cargo bed. Another common problem with prior art hose bed dividers used in fire trucks is a lack of overall smoothness, or in other words they often include small extending components such as bolt heads or rough surfaces such as weld beads, and multiple mount-tabs with insufficiently rounded or smoothed edges and corners, all of which leads to a higher than acceptable level of hoses being snagged or nicked when pulled out of the back of the truck.

I am not aware of any hose bed divider arrangements which are structured the same, or which offer all of the advantages of the present invention. It is believed there is need for improvements in hose bed dividers for use in the cargo beds of fire trucks. Such improvements would provide a hose bed divider for a fire truck which was competitive if not relatively low in overall price, being made of durable materials which could be readily installed and require little maintenance and preferably no painting; being such that the vertical divider panel could be readily re-positioned to re-define the widths of the storage areas on each side of the panel; being aesthetically pleasing when installed and remaining aesthetically pleasing for a long period of use, being resistant to denting, bending, scratching and corroding; and being structured free of extending small objects and excessively uneven surfaces (snags) which would otherwise snag hoses and other equipment being pulled from the cargo bed of the fire truck. The present invention provides such improvements in a hose bed dividing arrangement for a fire truck.

SUMMARY OF THE INVENTION

The following is generally of best modes and preferred structures for carrying out the invention, and although there are clearly some changes which could be made to that which is specifically herein described and shown in the included drawings, for the sake of briefness of this disclosure, all of these changes which fall within the scope of the present invention have not herein been detailed, but will be apparent to those skilled in the art upon reading this disclosure.

Disclosed is an improved hose bed divider panel and method of manufacturing and assembling same. A preferred mounting arrangement for the present divider panel is also detailed. The divider panel is for use in the back-end cargo or hose bed of a fire truck such as a pumper truck for dividing the cargo bed lengthwise, although it could be used to divide the bed transversely. The present invention provides an improved hose bed divider panel and divider panel mount structure for a fire truck which is relatively low in overall price, being made of durable and low maintenance materials which can be readily installed or assembled and which do not require painting; being such that the vertical divider panel can be readily re-positioned to re-define the widths of the storage areas on each side of the vertical divider panel; being aesthetically pleasing when installed, fitting well into the overall appearance of a typical pumper style fire truck, and remaining aesthetically pleasing for a long period of use; being resistant to denting, bending, scratching and corroding; and being structured generally free of extending small objects which could otherwise snag hoses and other equipment when being pulled from the hose bed of the fire truck.

A primary object of the present invention is to provide an improved hose bed divider panel which is defined as a one-piece structure substantially of aluminum (or an alloy substantially of aluminum) which is solid or not hollow, and which is shaped by extrusion, and this to provide a divider panel which is reasonably priced, has a high strength to weight ratio, does not require painting to prevent significant corrosion from water, and which requires relatively little human labor due to utilizing modern aluminum extrusion machines and techniques as the primary process to define the hose bed divider panel.

Another object of the invention is to provide an improved method of manufacturing an improved hose bed divider panel for dividing a fire truck cargo bed, wherein the method includes extrusion of the divider panel as a continuous one-piece solid structure substantially of aluminum, the utilization of extrusion allowing material thicknesses to be carefully controlled in all areas of the divider panel to allow frugal use of the aluminum while still providing a strong and durable divider panel wherein little waste and few scraps are produced during manufacturing of the panel.

Another object of the invention is to provide an improved hose bed divider for dividing a fire truck cargo bed, and which includes compatible structuring allowing the divider panel to be readily slid sideways and then be re-secured in place to allow re-sizing of the cargo storage sections on each side of the improved divider panel.

Another object of the invention is to provide an improved hose bed divider which can be extended in height through the use of compatibly structured extending panel(s).

Another object of the invention is to provide an improved hose bed divider panel preferably including markings such as grooves which are intended to be aesthetically pleasing and which tend to hide scratches and gouges which will inevitably occur with extended use.

Another object of the invention is to provide an improved hose bed divider arrangement for the back cargo bed of a fire truck which includes relatively few components, is simple, durable and which is relatively inexpensive in both the short and long term.

Another object of the present invention is to provide an improved hose bed divider for a fire truck which is aesthetically pleasing when installed, fitting well into the overall appearance of the common pumper style fire truck which typically includes many mill finish aluminum components such as side-mounted tool boxes, protective body panels and other permanently mounted parts of the truck.

These, as well as many other objects and advantages of the invention will be increasingly appreciated with continued reading and with a review of the attached drawings.

BEST MODE FOR CARRYING OUT THE INVENTION

Figure 1:
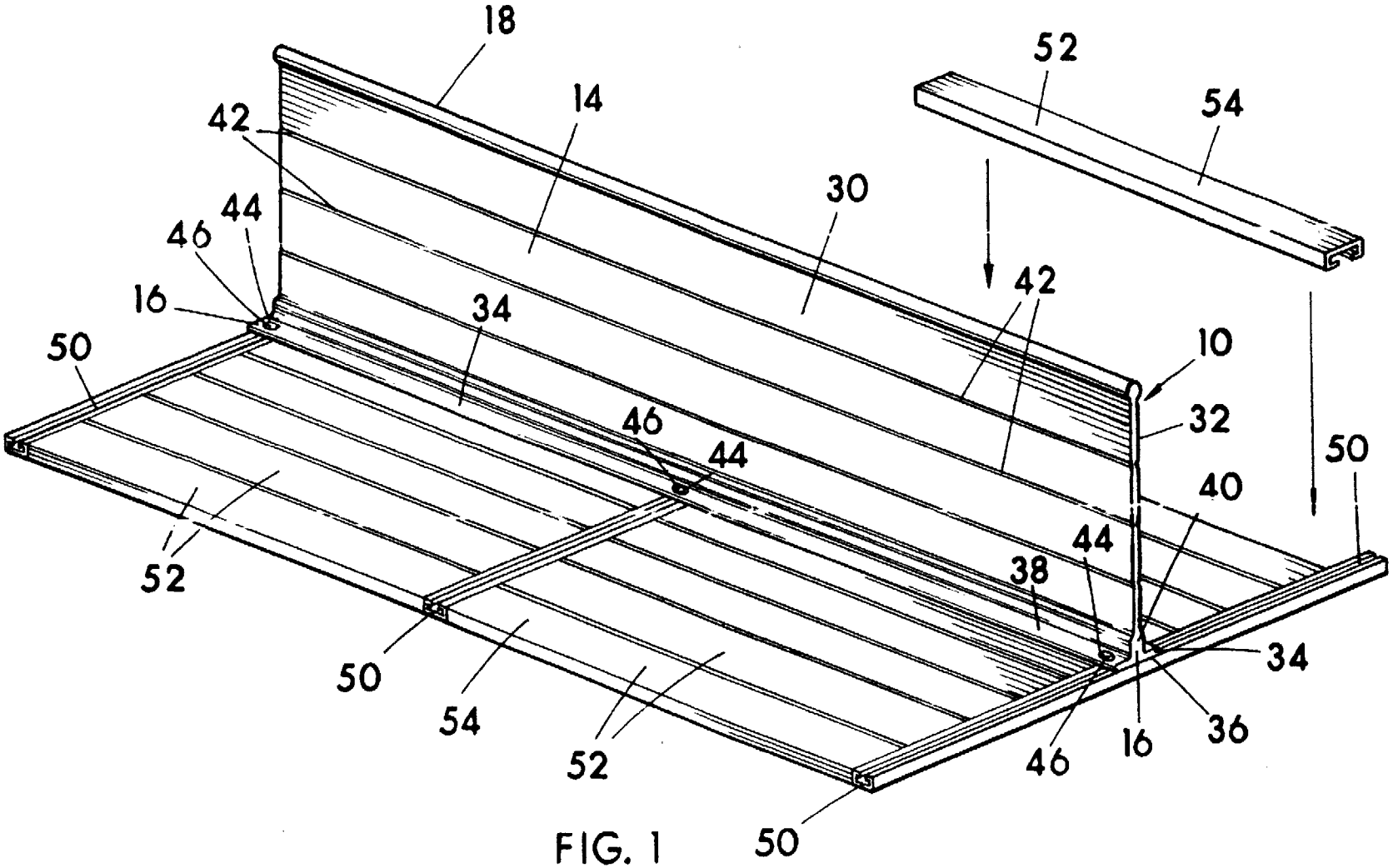
FIG. 1 shows a preferred embodiment of the present divider panel mounted on strut channel tracks with surrounding flooring for use in dividing a hose bed of a fire truck. One flooring slat is shown raised in position for installation.
Figure 2:
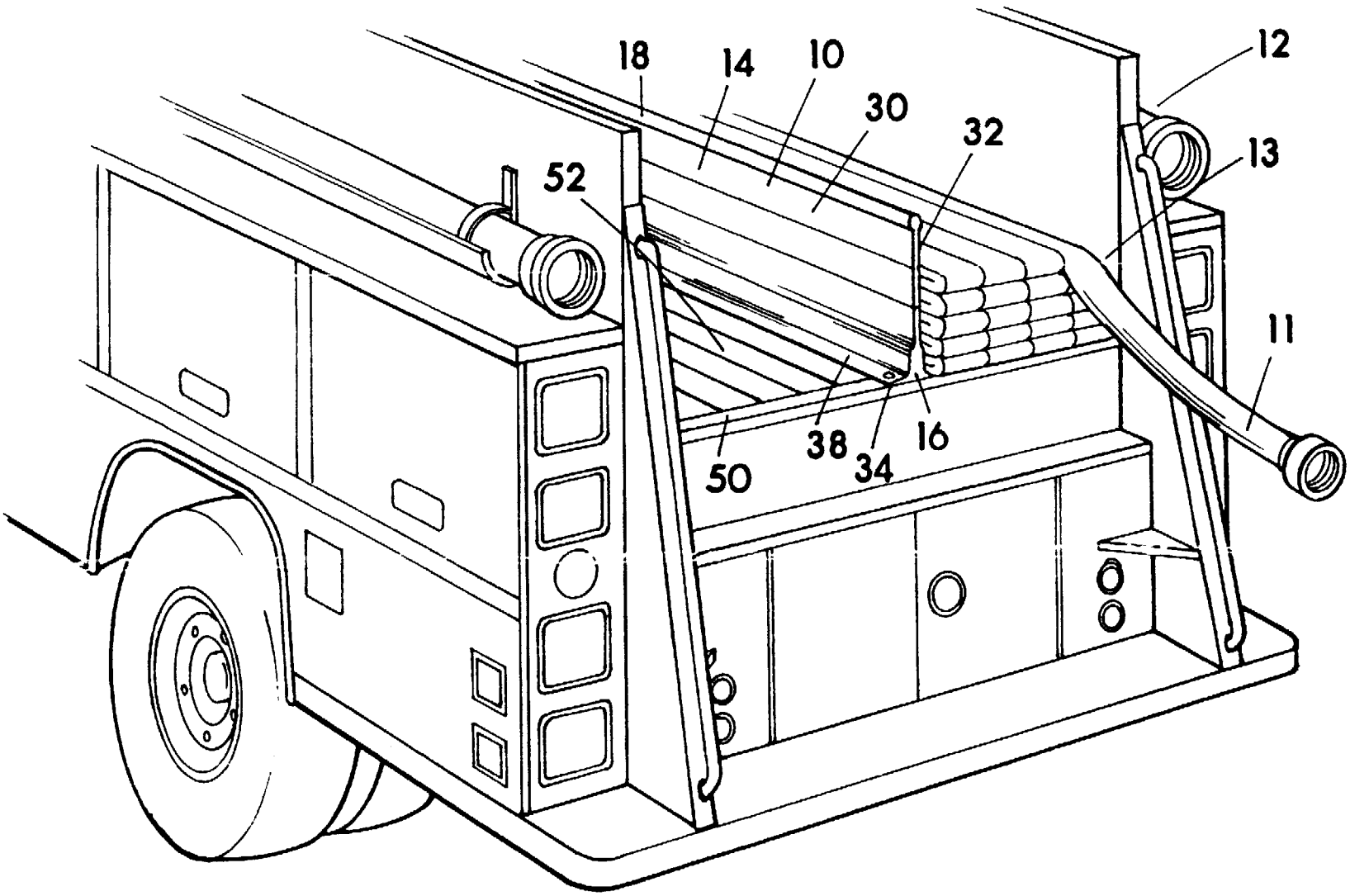
FIG. 2 shows the preferred embodiment of FIG. 1 installed in the cargo or hose bed of a pumper style fire truck. The view is a perspective view of the left rear of the fire truck.
Figure 3:
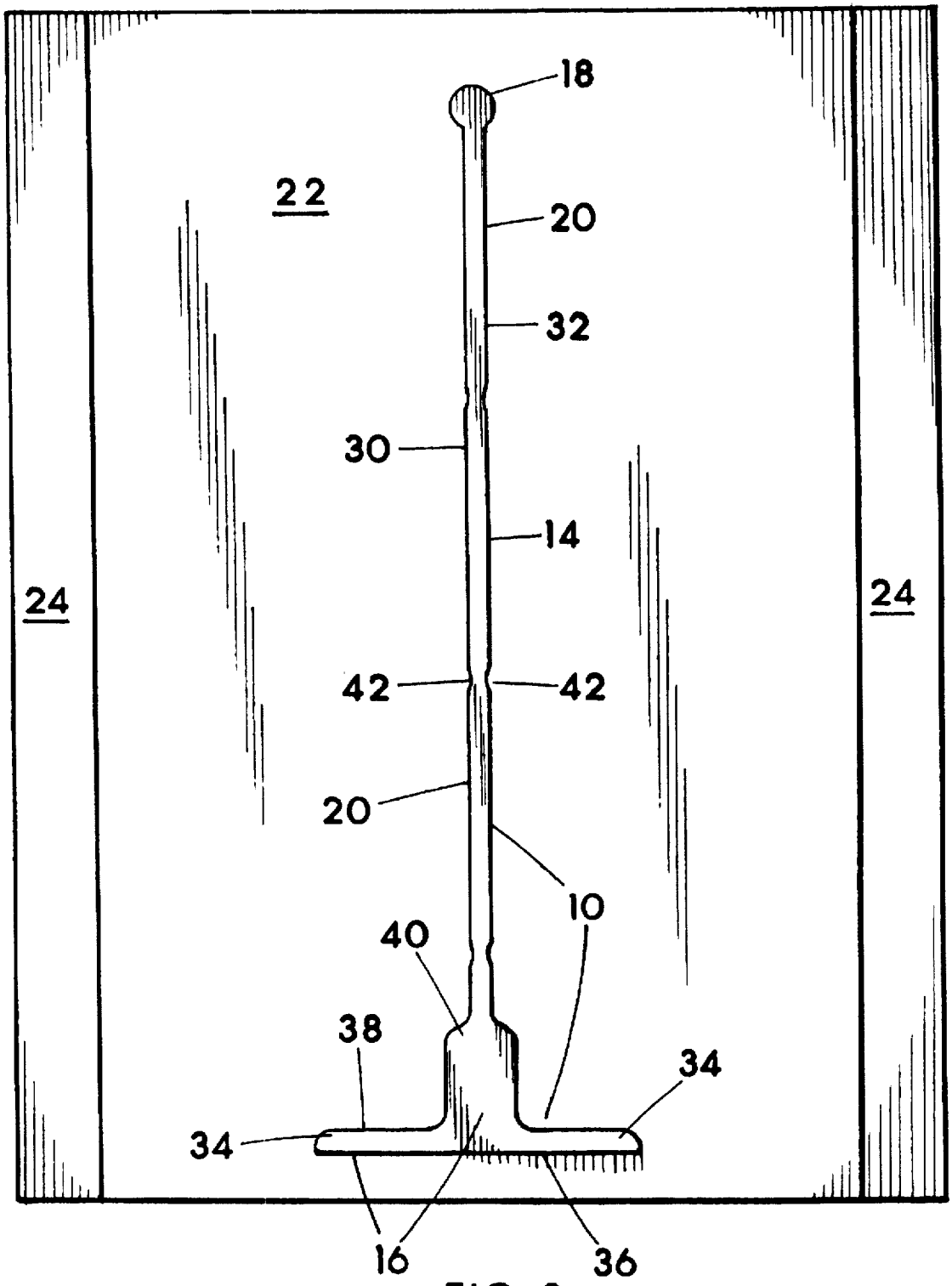
FIG. 3 is an end view of the divider panel of FIG. 1 as it is being manufactured by way of being extruded as hot metal through the properly shaped opening of an extrusion die of an aluminum extrusion press.

With reference to the drawings, in FIGS. 1–3, an improved hose bed divider panel 10 is shown in accordance with the principles of the invention. Hose bed divider panel 10, shown in the back cargo or hose bed of a fire truck 12 supporting or stabilizing high pressure hoses 11 with the assistance of the back side panel of tool box 13 in FIG. 2, is defined as a one-piece structure substantially of aluminum (or an alloy substantially of aluminum) which is solid (not hollow) and shaped by extrusion utilizing modern aluminum extrusion machines (presses) and techniques as the primary process to define the hose bed divider panel 10. 6063 T6 aluminum will function well from which to define divider panel 10, although other metals also preferably substantially of aluminum can also be used. The one-piece formation of divider panel 10 substantially of aluminum by way of extrusion provides an improved hose bed divider which, although it can be mounted stationary to a stationary member such as flooring within the hose bed of the fire truck using bolts, screws of the like absent any tracks or other arrangements allowing the ready re-positioning of the divider panel 10 within the hose bed, most users of the present improved divider panel 10 will prefer to mount the divider panel 10 using structuring and in a manner allowing the ready re-positioning of the panel 10 as will be described in detail later in this disclosure.

Figure 6:
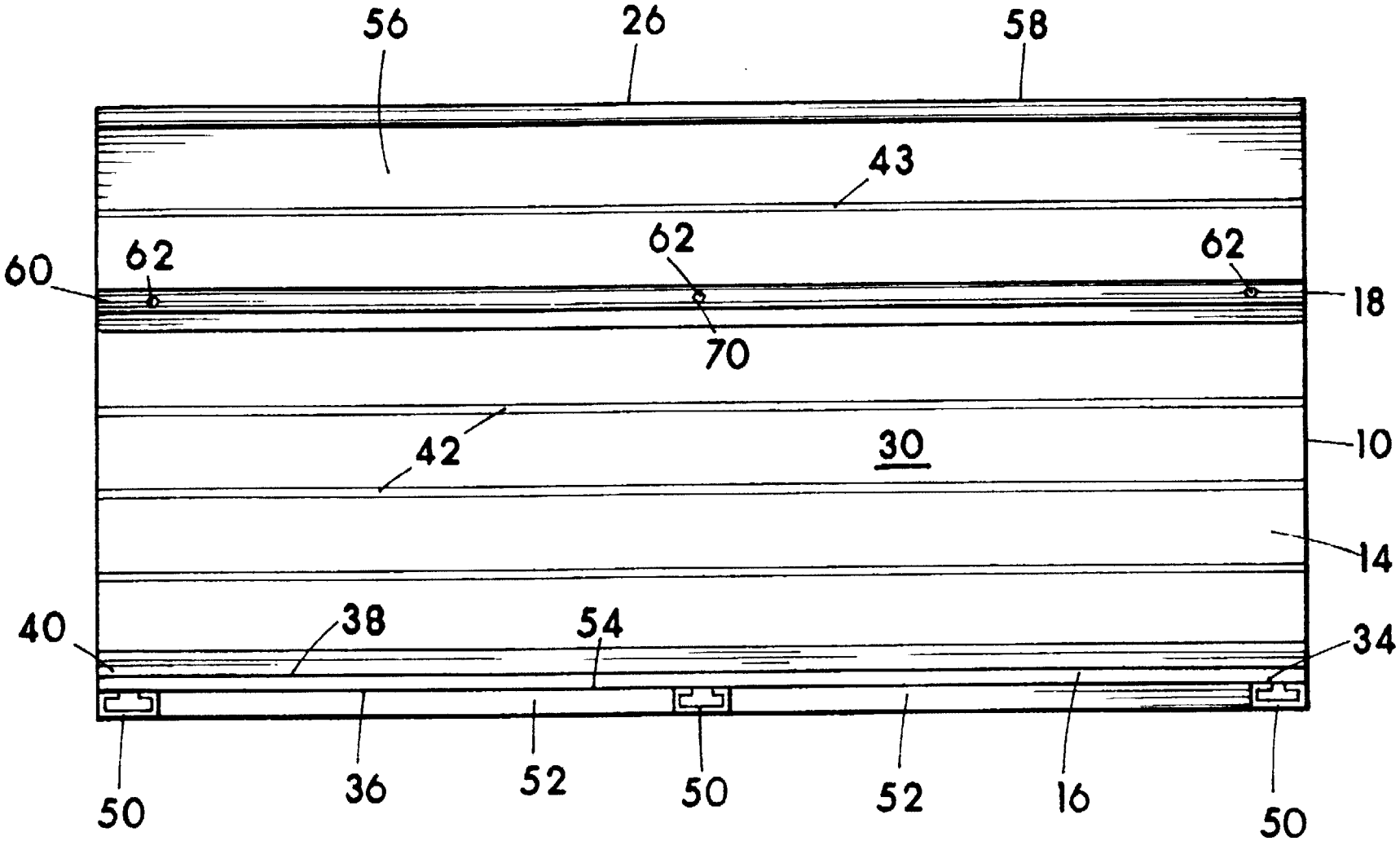
FIG. 6 is a side view the FIG. 1 preferred embodiment divider panel with an extending panel attached to the upper edge of the divider panel.

Divider panel 10 is a thin elongated structure having a length substantially greater than its height as can be ascertained from FIGS. 1 and 6. The length of divider panel 10 extends horizontally when the panel is mounted in a fire truck 12 as shown in FIG. 2, assuming the fire truck is on generally level ground. Divider panel 10 includes a thin or thin material intermediate portion 14 and an integrally attached widened bottom mount-base 16 and preferably an integrally attached widened bead-like top rail 18, all of which are formed together as a one-piece structure of extruded aluminum or an alloy substantially of aluminum. The one-piece structuring of the intermediate portion 14 with the mount-base 16 and top rail 18 by extruded aluminum provides a divider panel which is light in weight and yet still strong, durable and low maintenance. Aluminum (or alloys thereof) is relatively inexpensive for its strength to weight ratio, and as is or will become further appreciated, aluminum can be efficiently extruded for shaping, and does not normally require painting to prevent corrosion from water, un-like common steel. The one-piece construction of divider panel 10 with mount-base 16 and top rail 18 allows the divider panel to be made relatively inexpensively due to utilizing modern and efficient continuous aluminum extrusion machinery which requires relatively little human labor, as it can be appreciated the welding of a sheet to a peripheral frame as is common in the prior art is eliminated, as is much of the deburring and grinding associated with cutting, fitting and welding of components together to define a prior art style divider panel. The one-piece construction of the preferred divider panel 10 also provides a stronger more durable structure by way of eliminating weld beads between a panel and a mount-base which can crack with time. The extruded one-piece construction of the preferred divider panel 10 also provides a smoother overall structure since smooth radiuses in material-thickness changing areas are easily defined in extruded aluminum profiles without a great deal of labor intensive hand grinding as is required with individually fabricated prior art style divider panels.

FIG. 3 is illustrative of an end view of divider panel 10 as it is being manufactured of aluminum by way of being extruded through the properly sized and shaped opening 20 of an extrusion die 22 retained in an aluminum extrusion press 24. Structuring to support the hot and thus still flexible aluminum of the divider panel 10 as it leaves the die 22 until the aluminum cools and hardens has not been shown in this drawing. Once the extruding is started, the extrusion can be essentially continuous, and the continuous extrusion can be cut to any desired length using a metal cutting saw or any other suitable cutting arrangement. Extrusion of divider panel 10 leaves little to no wasted material, as extrusion is frugal with material because material thickness and sizes are readily controlled with a proper die, and leaves virtually no scraps, unlike the substantial amount of scraps typically left over with the prior art process of cutting and welding to individually fabricate a prior art style hose bed divider for a fire truck.

As can be seen from the drawings, the intermediate portion 14 of divider panel 10 is thin and wide (vertically tall in use), the width defining the height of the panel 10 as shown in FIG. 1 extending vertically upward from the support track and flooring, the track and flooring to be detailed later. The general thickness of the material in the intermediate portion 14 can be approximately ¼, but this can be varied within the scope of the invention. Divider panel 10 can feasibly be made in many different lengths, but divider panel 10 in lengths of six and twelve feet for example can be manufactured and will fit most needs associated with fire truck hose bed dividing, although divider panel 10 can be cut to length with a metal cutting saw in the field when desired, such as to define a nine foot long panel from a divider panel 10 originally manufactured twelve feet in length. Divider panel 10 preferably includes the enlarged bead-like top rail 18, integrally formed during extrusion and including a smooth radius so as not to cause injury to personnel or to snag hoses and other equipment pulled from the cargo bed. Top rail 18, which is preferably cylindrical in shape, serves the purposes of stiffening the upper or top edge of the intermediate portion 14 against bending, and enlarges the top edge of the panel 10 making it an exposed edge which is less likely to injure someone if they were to slip and fall onto the divider panel 10. Additionally, the enlarged top rail 18, which may be approximately ½ to ¾ inch across (but this can be varied within the scope of the invention), provides an enlargement extending the full length of the divider panel 10 which functions as a male member or tongue when extending the overall height of the divider panel 10 using an extending panel 26 which includes a full length female type groove 28 along what is considered the bottom edge of the extending panel 26. The specifics of the extending panel 26 and its attachment to the top edge of the divider panel 10 will be given later.

Across the width of intermediate portion 14 from top rail 18 is mount-base 16 which is integrally formed with intermediate portion 14 during the extruding of the panel 10. Mount-base 16 extends the full length of divider panel 10 and extends outward beyond the two oppositely disposed wide sides 30 and 32 of intermediate portion 14. In FIGS. 1 and 3, mount-base 16 can be seen extending outward in both directions of the wide sides 30, 32 of intermediate portion 14, and this provides a wide, central and thus stable base onto which divider panel 10 as a whole is rested or supported when mounted in a fire truck. The outward extending portions of mount-base 16 on each side of intermediate portion 14 are considered or will be referred to as flanges 34 for the purposes of describing the fastener receiving holes therethrough. Mount-base 16 is positioned at the bottom or lower edge of divider panel 10 when in use, and provides the divider panel 10 with an appearance of an inverted "T". Mount-base 16 extends laterally outward in two directions with intermediate portion 14 extending perpendicularly away from the center of mount-base 16 as can be seen in FIG. 3. Mount-base 16 includes what is considered a bottom surface 36 which is preferably flat for stable mounting and which is also considered to be the bottom of divider panel 10. Mount-base 16 also includes what is considered a top surface 38 positioned in use vertically above bottom surface 36. The material thickness of mount-base 16 between its top and bottom surfaces which is basically the thickness of flanges 34, can be approximately ¼ inch, although this can be varied within the scope of the invention. Mountbase 16 can be made approximately 3½ inches wide across its horizontal width as may be ascertained from FIG. 3, although this width can be varied within the scope of the invention. A relatively thick and thus strong material transitional portion 40 considered a portion of mount-base 16 integrally connected to both mount-base 16 and intermediate portion 14 provides connecting strength between mount-base 16 and intermediate portion 14. Smooth radiused transitions and corners are provided in most all areas of divider panel 10 by a proper extrusion die where material thicknesses are changed. As can be seen in the drawings, particularly FIGS. 1 and 3, the two oppositely disposed wide sides 30, 32 of intermediate portion 14 include grooves 42 which when in use extend horizontally or parallel to mount-base 16 and top rail 18 the entire length of divider panel 10. Grooves 42 can be spaced approximately sixes inches apart from one another on each side of divider panel 10, although the grooves 42 can be moved much closer together if desired, such as on two or three inch centers for example. Grooves 42 can be readily defined as a shallow radius groove made by the extruding with the extrusion die properly shaped to make the grooves. Grooves 42 can be placed and shaped differently than shown, as the primary purpose of the grooves is to serve to help hide gouges and scratches which will inevitably occur over extended use of the divider panel 10 in a fire truck. Grooves 42 shaped as shown in the drawings can be easily and economically formed during the extruding of the panel 10. From one vantage point, grooves 42 can be considered to be decorative grooves, although since the grooves breakup what would otherwise be a wide, smooth flat surface, when scratches or gouges are accidentally formed in either wide side of intermediate portion 14, the scratches or gouges are less noticeable with grooves 42 or the like, as opposed to a simply wide flat surface. Extending panel 26 is shown in the drawings with grooves 43 which are basically equivalent to grooves 42.

Generally speaking, panels of aluminum can only be extruded up to a given width, and this simply due to the unavailability of aluminum extrusion presses capable of extruding aluminum in widths wider than about 24 to 30 inches, at least to my knowledge. Although divider panel 10 in accordance with the present invention can be extruded in any desired width to define a panel when in use extending upward away from the fire truck cargo bed vertically upward to any desired height, feasibly in the U.S.A. at this time, to my knowledge, 24 inches would be about the maximum width which could be extruded with existing machinery, although in other locations of the world extrusion presses capable of extruding wider panels probably exist. The width which defines the height of divider panel 10 when in use will be desired to be different by different fire departments, whereas some fire departments may only wish the panel 10 to extend ten or twelve inches upward from the hose bed floor, whereas another fire departments may wish the divider to extend upward 36 inches or so. I see little purposes in manufacturing a divider panel in accordance with the present invention which extends upward less than about eight inches, as this is generally too low to function as a divider for a fire truck hose bed. Since many fire departments desire hose bed divider panels which extend in ranges between 12 and 36 inches upward from the hose bed floor, and 36 inch wide aluminum extrusions require extrusion presses which are not readily available, I suggest manufacturing divider panel 10 in widths to define the in-use height thereof in 12, 14 and possibly 24 inch wide panels. As will be described later, extending panels 26 are herein detailed which are structurally cooperative with divider panel 10 and can be used to extend the height of the divider panel 10.

Figure 4:
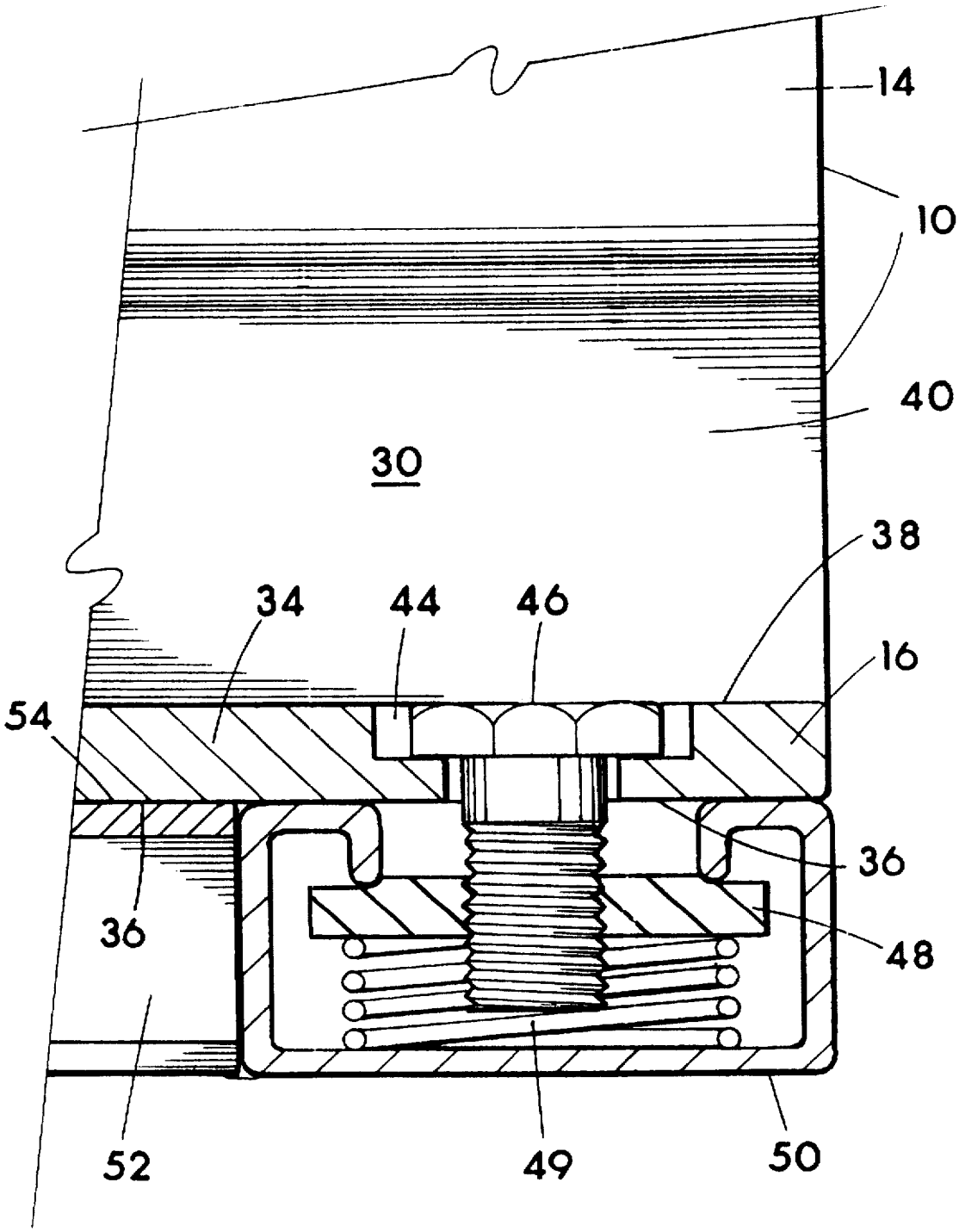
FIG. 4 is an enlarged segment drawing in partial cross section showing the bottom mount-base of the divider panel atop a strut channel member, and a bolt connecting the mount-base to a spring-nut trapped within the strut channel.

In order to allow attachment of divider panel 10, after it has been manufactured by extrusion as detailed above, at mount-base 16 to a stable or stationary supporting structure, vertical bolt holes 44 are suggested through flanges 34 (mount-base 16) to allow bolting or screwing through the mount-base 16 into a supporting structure beneath the bottom 36 of mount-base 16 and which is stationary in the fire truck hose bed. The bolt holes 44 should or preferably include two diameters, with a first or top diameter large enough to accept a bolt head recessed or flush with the top surface of the flange plus space outward around the bolt head for a socket of a wrenching tool, and the second or lower diameter of the bolt holes 44 just large enough for the free passage of the threaded shank of a bolt 46. In FIG. 4, a suitable bolt hole 44 is shown in mount-base 16, and a bolt 46 is shown within the bolt hole 44 and the head of the bolt flush or level with the top surface 38 of the mount-base 16 flange 34 to eliminate or greatly reduce hoses 11 and other equipment from hanging-up on the bolt head when pulled from the hose bed of the fire truck 12. Bolt holes 44 can be defined at the factory in a secondary process after extrusion or in the field (elsewhere of the initial manufacturing site) using drill bits, machining tools or the like suitable bore defining tools and equipment. Multiple bolt holes 44 should be applied on each flange 34 straight across from one another and on opposite sides of intermediate portion 14, at spaced intervals along the length of the mount-base 16 to allow the application of multiple bolts 46 along the length of the divider panel 10 on each side of intermediate portion 14 to ensure a secure, strong and stable mounting. Bolts 46 can be made of aluminum or an alloy of aluminum, but for increased strength purposes, bolts 46 made of stainless steel are preferred. Stainless steel bolts generally will not quickly react with aluminum when in contact therewith, and so corrosion between the stainless steel bolts and the aluminum of the mount-base 16 should not normally be a problem.

The bolts 46 are long enough to extend beyond the bottom 36 of mount-base 16 so as to be capable of reaching nuts 48 captive in strut channel members 50 as shown in FIG. 4. The preferred supporting component of divider panel 10 is a track arrangement of pieces or lengths of strut channel 50 located in the hose bed of the fire truck 12 and affixed or rendered stationary in the hose bed such as by welding, bolting, screwing, gluing or any other suitable attachment arrangement. The strut channel members 50 can normally be readily retained in proper location in the cargo bed by being welded or bolted at the terminal ends of the strut members 50 to the tool boxes 13 or vertical panels on the back sides of the tool boxes common on pumper trucks. Typically, the strut channel members 50 are properly located in the hose bed followed by the mounting of the divider panel 10 onto the channel members, although the entire assembly can be put together and then lifted into the truck cargo bed and then secured in place. The strut channel members 50 may be properly located in the hose bed and relative to pre-existing bolt holes 44 in mount-base 16, or the channel members 50 can be placed in the hose bed and the bolt holes 44 in mount-base 16 drilled to fit the location of the strut channel members 50. Strut channel 50 is available in various materials and sizes from many manufacturers and suppliers in the U.S. including Thomas Hardware, Parts & Fasteners, 1001 Rockland Street, Reading, Pa. 19604-1596. Strut channel can be purchased made of steel or substantially of aluminum. Aluminum strut channel is preferred for use with divider panel 10 so that corrosion between two dissimilar metals does not become a problem, and the aluminum strut channel will not typically need painting. Multiple pieces of strut channel 50 should be placed transversely of the length of the hose bed of the fire truck 12, or in other words to be transverse to the length of divider panel 10 as shown in FIG. 1. A length of strut channel 50 should be placed beneath each end of divider panel 10, and preferably a length of strut channel 50 in the middle also, so that adequate support is provided to the panel 10. The strut channel members 50 should be placed parallel to one another as shown in FIG. 1. Preferably the strut channel 50 is cut to length to be equal to the width of the cargo or hose bed so that when flooring slats 52 are applied, which will be detailed later, the entire cargo or hose bed of the fire truck includes a durable and generally flat flooring generally surrounding the area of the divider panel 10. The strut channels 50 should be located directly underneath the bolt holes 44 in mount-base 16 so that bolts 46 extending through the bottom of mount-base 16 can extend into the open interior of the strut channel 50 beneath the bolt hole 44 in mount-base 16. The bolts 46 extend through the lengthwise open side of the strut channel members 50. Strut channel 50 as is known and as shown in FIG. 4 includes a bottom and two oppositely disposed side panels extending perpendicularly away from the bottom panel and parallel to one another. The upper edges of strut channel turn inward for a short distance and then turn down to extend a short distance back toward the bottom panel of the strut channel as shown in FIG. 4. A lengthwise open mouth is defined in the strut channel between the two vertical side walls or panels, and a widened open space or cavity exists beneath the open mouth and laterally outward between the lower portions of the side walls as is well known and as shown in FIG. 4. Nuts 48, which are preferably spring nuts specifically designed for use with strut channel can be inserted into the open interior of the strut channel and rotated to extend the longer lengthwise axis of the nuts 48 across the width of the open mouth of the channel members 50 to be trapped or retained within the channel members 50 by abutment against the turned down portion of the side walls within the open mouth as shown in FIG. 4. Spring nuts 48 are available from the same suppliers of the strut channel 50, and include a compression spring 49 attached to one side of the nut to press the nut upward against the turned down portions of the side walls in the open mouth, with this to retain the nuts in position to allow the simple initial installation of a bolt into the nut. The nuts 48 each include a central threaded vertical bore for receiving the threaded shank of a bolt, and as can be seen in FIG. 4, mount-base 16 can be securely connected to strut channel 50 with nuts 48 and bolts 46. When the bolts 46 are tightened, the upper portion of the strut channel member 50 is tightly sandwiched between the spring nuts 48 and the flat bottom surface 36 of mount-base 16 resting atop the strut channel members 50, and divider panel 10 is rendered immovable relative to the strut channel 50 when the bolts 46 are tightened. When it is desired to re-define or re-size the spacing on each lengthwise side of the divider panel 10, bolts 46 can all be loosened with a wrenching tool, leaving the spring nuts 48 still threadably engaged on the shanks of the bolts 46, and then the divider panel 10 can be slid along the strut channel 50, assuming the multiple strut channel members 50 are parallel to one another to prevent jamming or binding, followed by re-tightening of the bolts 46. Strut channel members 50 of the approximately ¾ inch by 1½ width size will function well for defining the track arrangement upon which the extruded divider panel 10 is mounted, and such strut channel members are readily available in ten and twenty foot lengths which can be easily cut with a saw such as a hacksaw.

Figure 9:
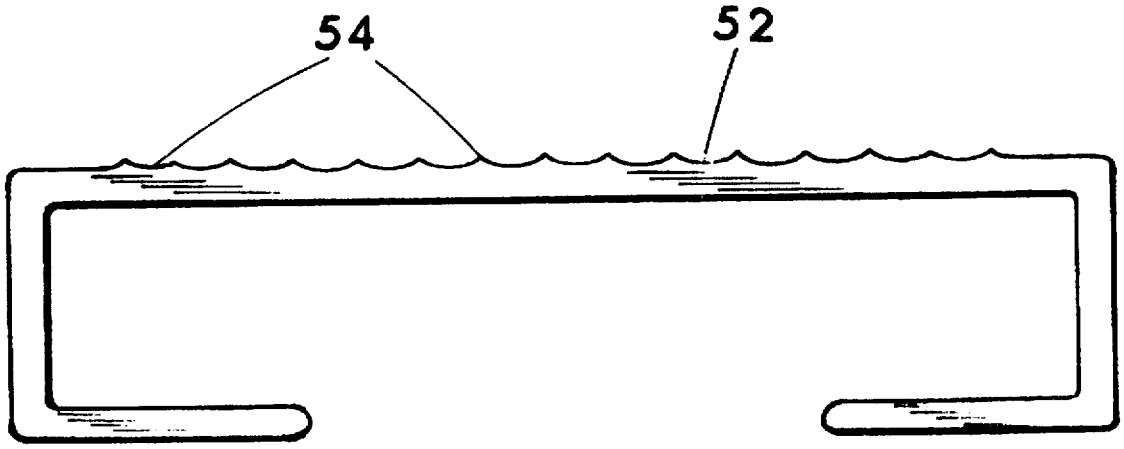
FIG. 9 is a transverse cross section of a preferred flooring slat having anti-slip ridges on the top surface.

In order that the hose bed in the fire truck 12 be generally flat so that it allows the general snag-free pulling of hoses and equipment from the hose bed, and it would not be if strut channel members 50 were simply surface-mounted on top of the existing hose bed floor or water tank in order to support divider panel 10, flooring slats 52 are recommended to be installed extending lengthwise oriented between the strut channel members 50 as shown in FIG. 1. Slats 52 are preferably made of aluminum, such as extruded aluminum, or an alloy substantially of aluminum, since the slats 52 contact strut channel members 50 which are also preferably made of aluminum. A cross section of a suitable and preferred flooring slat 52 is shown in FIG. 9, and a perspective view of the installed flooring slats 52 and one raised flooring slat 52 is shown in FIG. 1. The slats 52 shown in the drawing are elongated and about three inches wide, although this size is not critical. The slats 52 are hollow bodied and about ¾ of an inch thick or high. The standard thickness or height of most ¾ inch strut channel 50 is usually actually about 0.050 of an inch above the ¾ inch nominal or call size, and the slats 52 should be slightly less than the height of the strut channel 50, but what is important is that the slats 52 when positioned lengthwise as shown in FIG. 1, that the top surfaces of the slats 52 be positioned or positionable slightly below the top surface of the strut channel 50 and slightly below the bottom surface 36 of the mount-base 16 so that when it is desired to re-position divider panel 10 by way of loosening the bolts 46 to slide the panel 10 as described above, that clearance is provided between bottom surface 36 and the top surfaces 54 of the slats 52. A plurality of elongated slats 52 can be cut to length to fit lengthwise in between the parallel strut channel members 50 and placed perpendicular to the channel members as shown in FIG. 1 to define a flooring in the hose bed surrounding the base of divider panel 10, although the slats 52 placed transversely or parallel to the strut channels members 50 would not be considered outside of the scope of the invention. Slats 52 should be installed with a small amount of spacing between each slat in order to drain water. The preferred slats include anti-slip ridges or other suitable anti-slip formations on the top surfaces 54 thereof to help prevent a fireman from slipping when standing on the flooring. The slats 52 can be fixed in place by way of welding, although other suitable connecting or fastening arrangements such as countersunk bolts or screws could be used. The welding can be applied at the lengthwise terminal ends of each slat 52 to the adjacent strut channel member 50. The top surface of the slats 52 should be positioned slightly below the top surface of the strut channel 50 and below the bottom surface of the divider panel 10 50 that the divider panel 10 can be slid on the strut channel members without interference from the slats 52, and so that the bottom 36 of the mount-base 16 rests directly upon the tops of the strut channel members 50. When the divider panel 10 is mounted in a fire truck 12 atop a track structure made of strut channel 50 or an equivalent track arrangement, as shown in FIG. 2, assuming the truck 12 is level, the strut channel members 50 are lengthwise horizontally disposed, and the divider panel 10 is extending upward vertically away or perpendicularly from the strut channel 50 and the flooring slats 52.

Also provided is a second divider panel or extending panel 26 useful for adding to the height of divider panel 10. The extending panel 26 includes an extruded aluminum thin intermediate portion 56, an integrally attached extruded aluminum bead-like top rail 58 preferably cylindrical and structured preferably identically to the top rail 18 of divider panel 10, and an extruded aluminum attachment-base 60 shaped to include or define a female type lengthwise open center groove 28 sized and shaped for receiving the male-like top rail 18 of divider panel 10 for extending the overall height of the divider panel within the cargo bed. Extending panel 26 is made as a one-piece extruded aluminum structure for basically the same reasons and to gain many of the same benefits as divider panel 10. Extending panel 26 when used is or should be the same length as the divider panel onto which it is attached. The manufactured width (in use vertical height) of the divider panel 26 can be varied widely within the scope of the invention, however the widths which I believe extending panel 26 should be manufactured to be most useful is six inch and five inch widths, and possibly a twelve inch wide panel 26, as the five and six inch widths allow extending the height of divider panel 10 in five or six inch increments which should allow the installer to bring the overall height of the divider panel upward from the floor to any desired height within one inch, which should be close enough for most applications.

Figure 5:
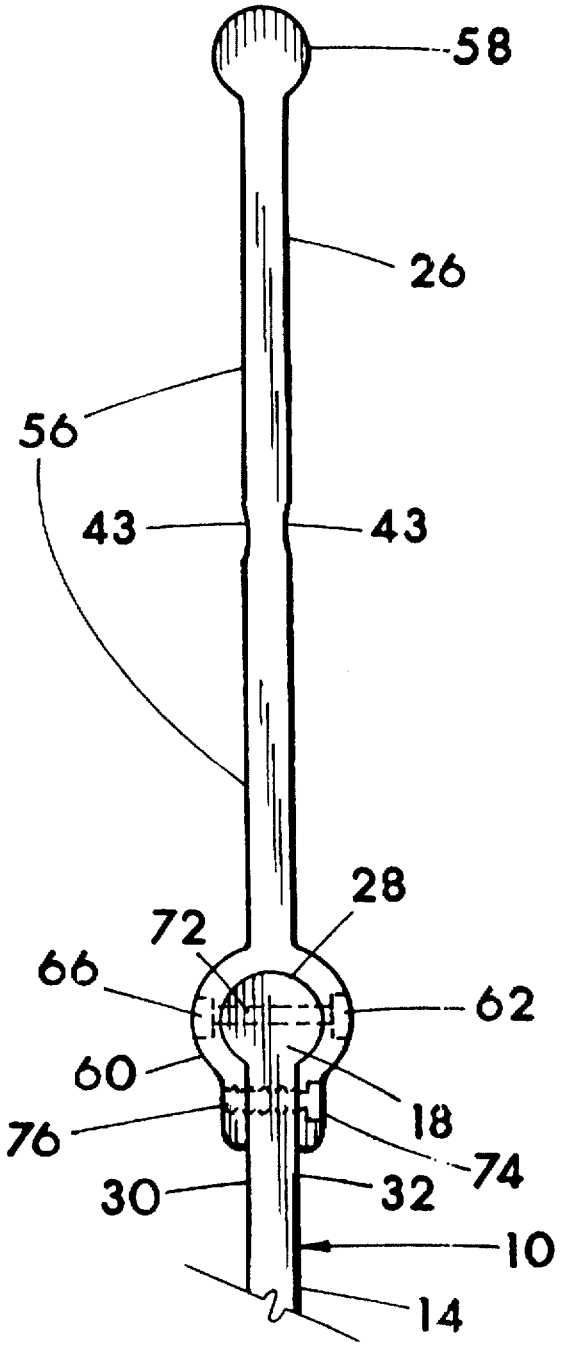
FIG. 5 is an end view of the top portion of the divider panel having an extending panel affixed atop the divider panel to extend the divider panel in height. Two arrangements of cross bolt are shown in broken lines as examples for connecting the grooved female attachment-base of the extending panel to the male-like top rail of the divider panel.
Figure 7:
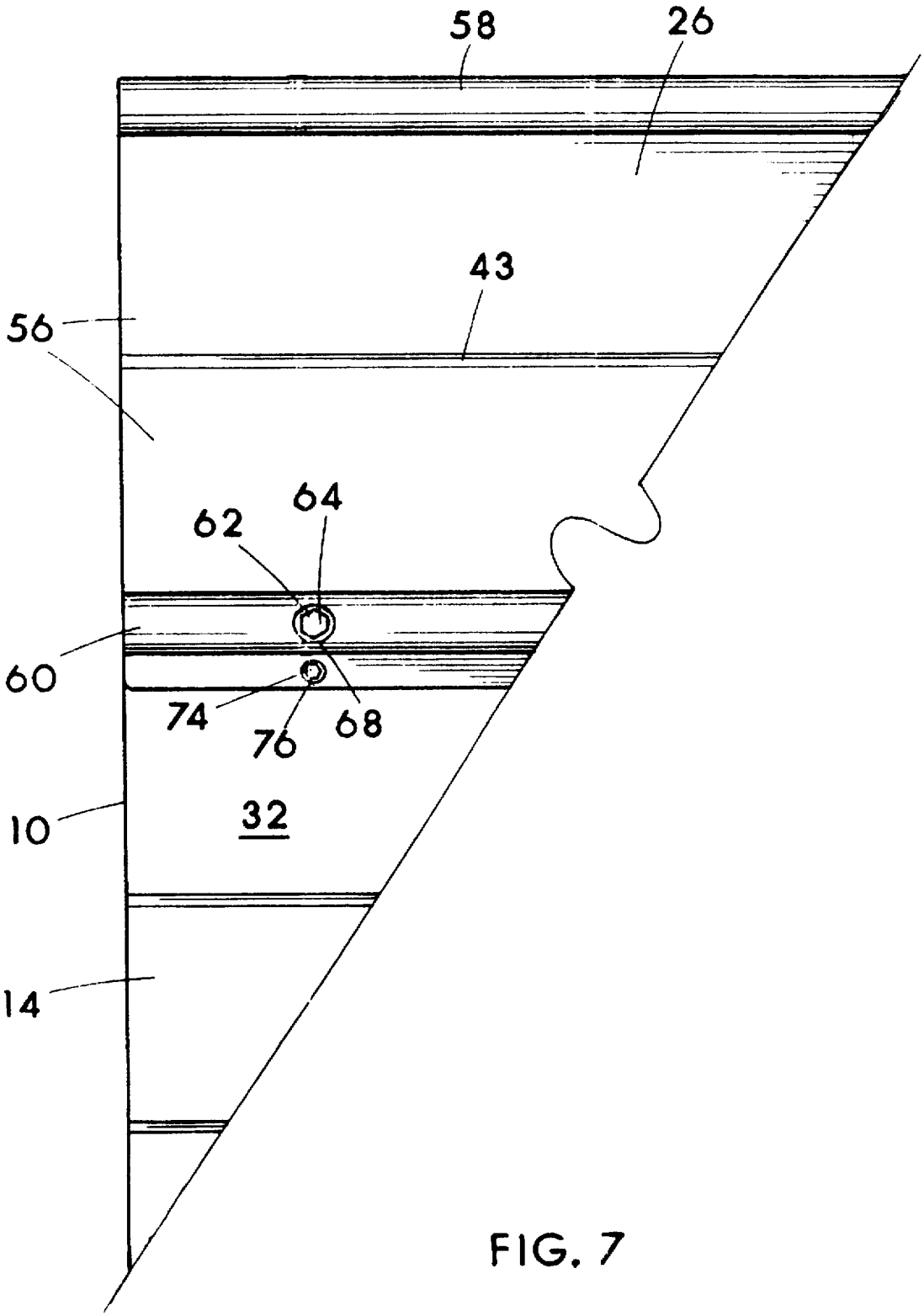
FIG. 7 is a fragmentary view of the upper portion of the divider panel with the extending panel attached thereto.
Figure 8:
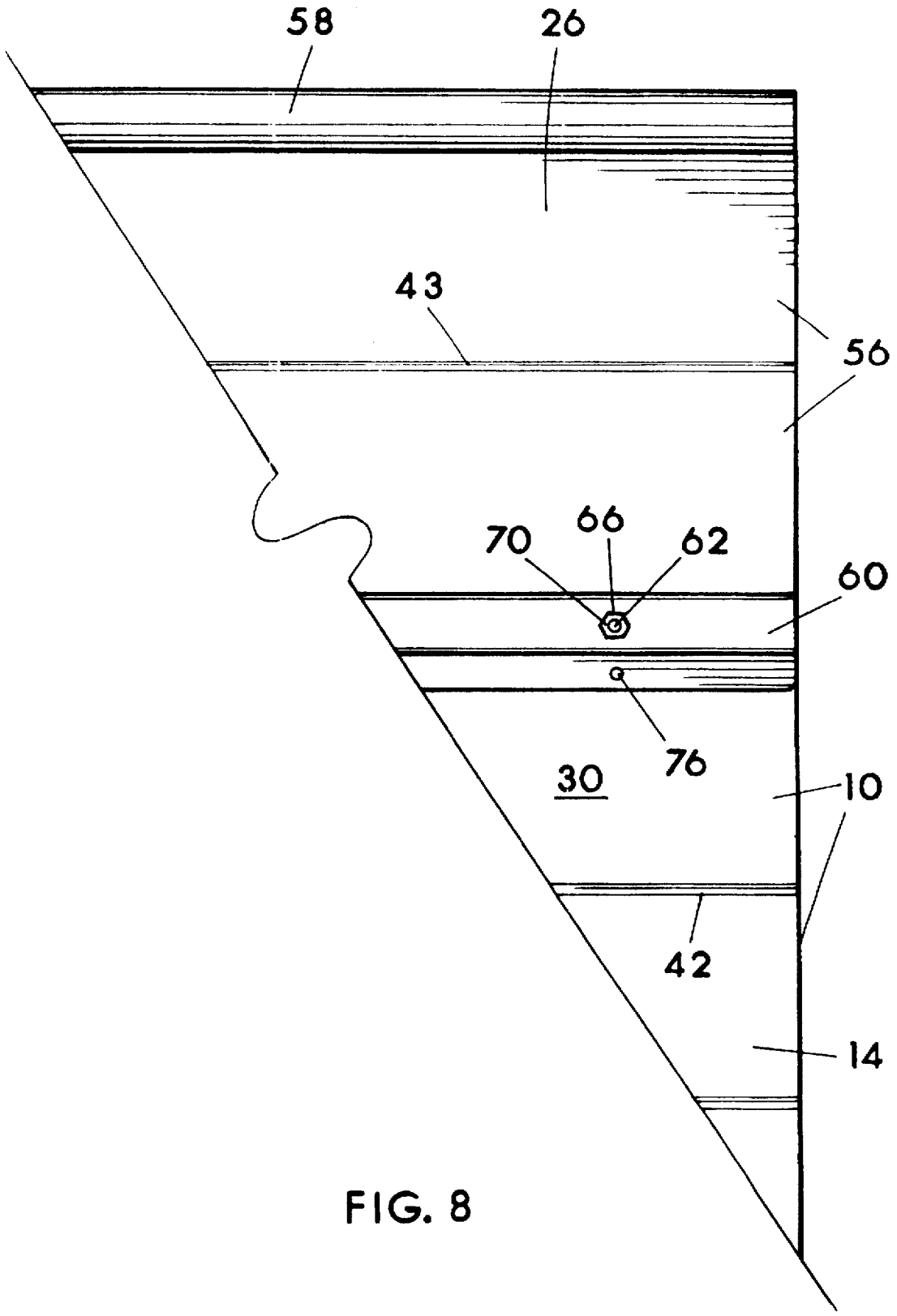
FIG. 8 is a fragmentary view of the upper portion of the divider panel with the extending panel attached thereto from the opposite side shown in FIG. 7.

Additional extending panels 26 can be attached one atop another to extend the overall height of the divider panel extending from the cargo bed floor upward to any desired height. The groove 28 of the extending panel 26 once located on or approximately surrounding top rail 18 of divider panel 10, or of another extending panel 26, can be secured in place through the use of modern adhesives, by welding (smooth welds), or by the use of a plurality of bolts, rivets or the like mechanical fasteners which are preferably recessed or countersunk so as to not extend outward to snag gear. As an example of the use of bolts for connecting the bottom grooved edge of extending panel 26 to the top edge of divider panel 10, two different bolting arrangements are shown in FIGS. 5, 7 and 8 for example wherein in one arrangement a plurality of cross bolts 62 with countersunk heads 64 and nuts 66 are utilized. In FIG. 7 the head 64 of bolt 62 is recessed within a larger hole of a multiple diameter bolt hole 68 in the curved material of the extending panel 26, and in FIG. 8 the nut 66 on the threaded shank end of bolt 62 is recessed in a hexagonal hole 70 in the curved material of the extending panel 26 wherein the nut 66 fits tightly in the hexagonal hole 70 and cannot spin therein. The hole 68 for the head 64 of the bolt 62 should be large enough for the socket of a wrenching tool around the bolt head. Bolt 62 should not be so long as to extend outward of the outer material of the extending panel 26 as indicated in FIG. 5 since smoothness for reducing hose and equipment snagging is desired as mentioned above. A horizontal or transverse hole 72 through the top rail 18 of divider panel 10 accommodates the free passage of the threaded shank of bolt 62 where appropriate. Holes 72 in top rail 18 can be drilled at the manufacturing plant, or can be drilled in the field when and if needed. Multiple bolts 62, nuts 66 and bolt holes are applied at spaced increments along the length of the connection between the top rail 18 of divider panel 10 and the bottom groove 28 of the extending panel 26 as may be ascertained from FIG. 6. A second arrangement utilizing bolts 74 for connecting the bottom grooved edge of extending panel 26 to the top edge of divider panel 10 is shown in FIGS. 5, 7 and 8. In this second bolting arrangement which would not normally be used if the first just previously described bolting arrangement were used, a hole or bore 76 is defined through the lower flange portions of extending panel 26 on either side of divider 10, and through divider 10, as may be ascertained from FIG. 5, and bolt 74 applied as shown. The first bore portion in the flange of extending panel 26 near the head of the bolt 74 should be unthreaded, and should have a recess allowing the head of bolt 74 to be countersunk. The bore portion of bore 76 through divider panel 10 and into and through the flange portion of extending panel 26 away from the head of bolt 74 should be tapped with threads for engaging the threaded shank of bolt 74. As may be ascertained from FIG. 5, the shank end of bolt 74 which does not include the head should not extend outward of the surrounding material of the bottom of extending panel 26. Multiple bolts 74 are applied at spaced increments along the length of the connection between the top rail 18 of divider panel 10 and the bottom groove 28 of the extending panel 26.

The groove 28 of extending panel 26 as shown in FIG. 5 is shaped in a manner requiring the groove of extending panel to be slid into place from one end of divider panel 10 since the downwardly open mouth of the groove 28 is narrower than the more upward open interior of the groove and narrower than top rail 18 of divider panel 10. This arrangement locates the flange-like material below groove 28 in which bolts 74 can be applied tightly against oppositely disposed sides of divider panel 10 below top rail 18 as may be seen in FIG. 5, with this tightly abutted material adding stability against the extending panel 26 rocking laterally on the divider panel 10, although the mouth of the groove 28 could be made sufficiently wide to simply drop straight downward onto top rail 18 of divider panel 10, in which case the first bolting arrangement using bolts 62 and nuts 66 as previously described would be used if bolting were to be chosen as the fastening arrangement between extending panel 26 and divider panel 10. Again, adhesives, welding or rivets or other fastening arrangements can be used to connect extending panel 26 to the top edge of divider panel 10 instead of the bolts 62 or 74 as previously described, however the use of bolts allows for the ready removal of extending panel 26 from divider panel 10 when desired, such as to replace a severely damaged extending panel 26 for example. Although not shown in the drawings, but previously mentioned, extending panels 26 may be attached one atop another in combination with a divider panel 10 as the base, and affixed together using one of the bolting arrangements previously described or with any other suitable attachment arrangement.

Although I have very specifically described the preferred structures and use of the invention, it should be understood that some changes in the specific structures described and shown in the drawings may clearly be made without departing from the true scope of the invention in accordance with the appended claims.

What is claimed:

1. An improved fire truck hose bed dividing structure of the type including an elongated divider panel connected with fasteners to stationary structuring within a fire truck hose bed, the divider panel extending vertically upward from said stationary structuring and dividing the fire truck hose bed into at least two areas; wherein the improvements comprise;

the divider panel comprising a one-piece extruded structure substantially of aluminum and including a relatively wide top rail integrally connected to a relatively thin intermediate panel portion integrally connected to a widened mount-base portion continuous along a bottom edge of said intermediate panel portion; the mount-base portion extending laterally outward of each of two sides of said intermediate panel portion and providing a widened base centralized beneath said intermediate panel portion, the mount-base portion including a plurality of multiple-diameter fastener receipt holes with said fasteners in-part within said holes and with heads of said fasteners recessed within an upper diameter of the holes and primarily below a top surface of said mount-base portion.

2. An improved fire truck hose bed dividing structure of the type including strut channel members as a supporting track structure beneath an elongated divider panel connected with fasteners to the strut channel members; wherein the improvements comprise;

the divider panel comprising a one-piece structure substantially of extruded aluminum including a relatively thin intermediate portion between a widened top rail portion equal in length to and continuous along said intermediate portion, and a widened mount-base portion ecrual in length to and continuous along a bottom of said intermediate portion; the mount-base portion extending laterally outward of each of two sides of said intermediate portion at a bottom of said divider panel and providing a widened base centralized beneath said intermediate panel portion; said divider panel at least a minimum of eight inches in height, and at least approximately six feet in length so as to be of useful height and length as a divider panel for providing lateral support to serpentine folded and stacked water hoses in a fire truck hose bed.

3. An improved method of assembly of a fire truck hose bed dividing structure, comprising the steps of;

(a) extruding an elongated divider panel as a one-piece structure substantially of aluminum and including a relatively thin upper panel portion integrally connected to a lower widened mount-base portion and an upper widened top rail portion; the mount-base portion extending laterally outward of each of two sides of said panel portion at a bottom of said panel portion and extending continuously the full length of said panel portion;

(b) defining a plurality of holes for receiving fasteners through said mount-base portion;

(c) defining a track structure of multiple strut channel members positioned in spaced relationship and parallel to one another;

(d) locating a bottom surface of said mount-base portion upon said track structure with said holes positioned over said track structure;

(e) fastening said mount-base portion to said track structure utilizing bolts inserted into and partly through said holes within said mount-base portion and into nuts within said track structure, said nuts being slidably re-positionable within said track structure with said bolts in a loosened condition, said bolts being of a type which can be loosened and tightened when desired to allow re-positioning of said mount-base portion and thus said divider panel relative to said track structure and, (f) recessing heads of said bolts within said holes within said mount-base portion so as to provide a degree of smoothness full-length along a top surface of said mount-base portion.

4. An improved method of assembly of a fire truck hose bed dividing structure according to claim 3 further including the steps of positioning a plurality of slats extending between said strut channel members of said track structure, positioning upper surfaces of said slats below upper surfaces of said strut channel members and below said bottom surface of said mount-base portion, and affixing said slats in position so as to provide a degree of level smoothness between said strut channel members of said track structure.

5. An improved method of assembly of a fire truck hose bed dividing structure according to claim 4 further including the step of extending said divider panel vertically in height by way of attaching an extending panel to said top rail so as to allow increased vertical stacking of serpentine folded water hoses.

6. A fire truck hose bed divider panel which comprises:

a one-niece solid extruded structure substantially of aluminum and including a relatively thin intermediate portion, a widened top rail portion continuous along a first edge of said intermediate portion, a widened mount-base portion continuous along a second edge of said intermediate portion, the mount-base portion extending laterally outward of each of two sides of said intermediate portion at a bottom of said divider panel and providing a centralized widened base beneath said intermediate portion, said divider panel at least a minimum of ten inches in height, and at least approximately six feet in length so as to be of useful size as a divider panel for providing lateral support to serpentine folded and stacked water hoses in a fire truck hose bed.

7. A fire truck hose bed divider panel according to claim 6 further including a height extending panel affixed to said top rail portion of said divider panel;

said extending panel comprising, a one-piece structure substantially of aluminum and including a relatively thin intermediate portion, a widened top portion continuous along a first edge of said intermediate portion, and an attachment base continuous along a second edge of said intermediate portion of said extending panel, said attachment base including an elongated groove;

said elongated groove positioned over said top rail portion of said divider panel.

8. A fire truck hose bed divider panel according to claim 7 further including a plurality of fastener receipt holes located vertically through said mount-base portion on each of said two sides of said intermediate portion of said divider panel.

9. A fire truck hose bed divider panel according to claim 8 further including shallow elongated grooves extending lengthwise on each of two sides of said intermediate portion of said divider panel to aid in hiding any scratches.

10. A fire truck hose bed divider panel according to claim 9 wherein said widened top portion of said extending panel is sized and shaped substantially the same as said top rail portion of said divider panel.

11. A fire truck hose bed divider panel according to claim 10 wherein said fastener receipt holes are each multiple-diameter holes each having a larger upper diameter over a smaller lower diameter, the larger upper diameter of said holes sized to allow recessing of fastener heads within said mount-base portion.

* * * * *